United States Patent [19]

Ubukata et al.

[11] Patent Number: 4,672,353

[45] Date of Patent: Jun. 9, 1987

[54] SNAP-ACTION TYPE THERMALLY RESPONSIVE SWITCH

[75] Inventors: Susumu Ubukata, 549-banchi, Nakasuna-cho, Tempaku-ku, Nagoya-shi, Aichi-ken; Yasukazu Mizutani; Syozo Iyoda, both of Nagoya, all of Japan

[73] Assignee: Susumu Ubukata, Japan

[21] Appl. No.: 910,952

[22] Filed: Sep. 24, 1986

[30] Foreign Application Priority Data

Oct. 14, 1985 [JP] Japan ..... 60-227990

[51] Int. Cl.[4] ..... H01H 37/12; H01H 37/54

[52] U.S. Cl. ..... 337/368; 337/347; 337/365

[58] Field of Search ..... 337/368, 365, 360, 347, 337/94, 82, 57

[56] References Cited

U.S. PATENT DOCUMENTS 3,587,022 6/1971 Hire ..... 337/94

4,389,630 6/1983 Ubukata et al. ..... 337/368

*Primary Examiner*—Harold Broome

*Attorney, Agent, or Firm*—Steele, Gould & Fried

[57] ABSTRACT

A thermally responsive snap-acting switch consists of an elastic plate cantilever mounted at one end on a header, a thermally responsive element which includes a central dish-shaped portion for inducing snap action and one end of which is connected with the other end of the elastic plate in an opposed relation to the elastic plate, a support one end of which includes a portion receiving a connection between the elastic plate and the thermally responsive element so that it slides and is inclined on the receiving portion, and a projection which exerts a force on the dish-shaped portion of the thermally responsive element to calibrate the operative temperature of the thermally responsive element. The calibration is performed either by employing a screwed stud as the projection or by plastically deforming the receiving portion of the support.

6 Claims, 6 Drawing Figures

SNAP-ACTION TYPE THERMALLY RESPONSIVE SWITCH

BACKGROUND OF THE INVENTION

1. Field of the Invention

This invention relates to a thermally responsive switch in which a thermally responsive bimetallic element including a shallow dish-shaped portion snaps in response to the ambient heat or due to self-heating to thereby make and break fixed and movable contacts, and more particularly to such a switch which has an operative temperature calibrating mechanism for setting the thermally responsive temperature by applying an external force to a convex side of the dish-shaped portion of the thermally responsive element when the element is in the contacts-closed position.

2. Description of the Prior Art

In the thermally responsive switch of the type described above, a thermally responsive element includes a shallow dish-shaped portion formed by way of drawing and is cantilever mounted in a cylindrical switch case or housing. A movable contact is mounted on a free end of the thermally responsive element in opposed relation to a fixed contact. Further, the switch is provided with a means for calibrating the operative temperature of the thermally responsive element. As one of such a calibrating means, a depressing member is provided in the housing. The member is depressed against the convex side of the dish-shaped portion of the thermally responsive element. Stress exerted on the convex side is adjusted by changing the intensity of pressure exerted by the depressing member, thereby calibrating the operative temperature of the thermally responsive element.

In the above-described construction, however, the stress exerted on the convex side by the depressing member is concentrated in the vicinity of a supported end of the thermally responsive element, which causes the supported end to suffer plastic deformation, thereby narrowing a range of operative temperature to be calibrated.

Furthermore, where a stud bolt is employed as the depressing member, the calibrated temperature changes in the course of use of the switch due to the loosening of the stud bolt. Another member such as a spring washer or double nut is employed to prevent the stud bolt from loosening, which renders the calibrating work difficult. Although the pressure against the dish-shaped portion of the thermally responsive element can also be gained by the bending deformation of the depressing member other than the stud bolt, spring back induced at a bent portion of the depressing member changes the calibrated operative temperature.

SUMMARY OF THE INVENTION

It is, therefore, a primary object of this invention to provide an improved snap-action type thermally responsive switch in which the operative temperature of the thermally responsive element is calibrated with ease.

It is a second object of this invention to provide an improved snap-action type thermally responsive switch in which the thermally responsive element is prevented from suffering plastic deformation when the operative temperature is calibrated by applying an external force thereto with the calibrating means, thereby enlarging the range of temperature to be calibrated.

It is a third object of this invention to provide an improved snap-action type thermally responsive switch in which the change of the calibrated operative temperature of the thermally responsive element with a lapse of time is limited to a lowest frequency of occurrence to thereby maintain the precise operative temperature of the thermally responsive element for a long time.

According to this invention, a snap-action type thermally responsive switch comprises a thermally responsive element such as bimetal for opening and closing movable and fixed contacts and an elastic plate having easier elastic deformability than the thermally responsive element. The thermally responsive element includes a a shallow dish-shaped portion formed by way of drawing at a suitable area thereof, which dish-shaped portion induces the snap action of the thermally responsive element. One end of the elastic plate is connected with one end of the thermally responsive element in opposed relation.

The elastic plate is cantilever mounted at the other end on a support. The connection between the elastic palte and the thermally responsive element is placed on a receiving portion of the support so as to be slidable and inclinable thereon. A depressing member is provided for applying pressure to a convex side of the dish-shaped portion of the thermally responsive element when it is in the contacts-closed position.

Calibration of the operative temperature of the thermally responsive element is performed by changing the intensity of pressure exerted on the thermally responsive element with the depressing member. In this case, since the connection between the elastic plate and the thermally responisve element slides and is inclined on the receiving portion of the support when the pressure intensity is changed, the pressure is prevented from being concentrated on part of the thermally responsive element such that the element suffers elastic deformation.

In a first aspect of this invention, the depressing member for exerting pressure on the thermally responsive element is a stud bolt, which is threaded through the support. To prevent the stud bolt from loosening after adjustment thereof, elongated slits are formed in the support so as to cross the threaded portion, thereby applying a spring force to the stud bolt.

In a second aspect of this invention, the receiving portion of the support is a closed-loop wall which defines an opening for receiving the connection between the elastic plate and the thermally responsive element at an inner edge thereof. The pressure exerted on the dish-shaped portion with the depressing member is changed by causing the closed-loop wall to suffer plastic deformation so that the place of the receiving portion for receiving the connection is changed. In this case, since the receiving portion has a construction of the closed-loop wall, the spring back is not induced after the support suffers plastic deformation. The stud bolt as the depressing member is effectively prevented from loosening and the spring back is also prevented in the switch in accordance with this invention, which provide a long maintenance of the calibrated operative temperature of the thermally responsive element.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF PREFERRED EMBODIMENTS

Figure 1:
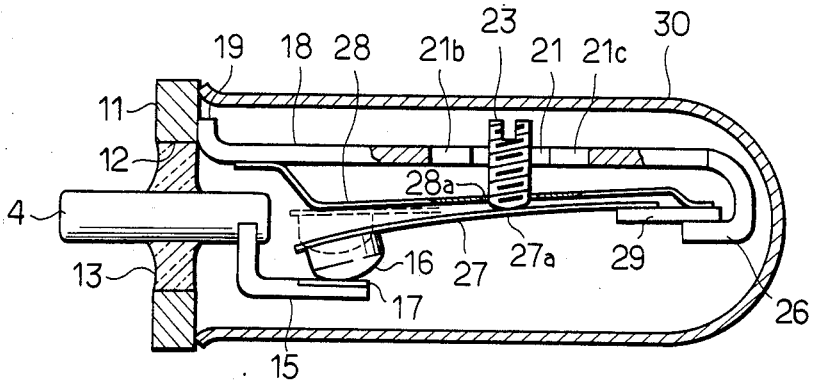
FIG. 1 is a longitudinal cross sectional view of a snap-action type thermally responsive switch of a first embodiment in accordance with this invention.
Figure 2:
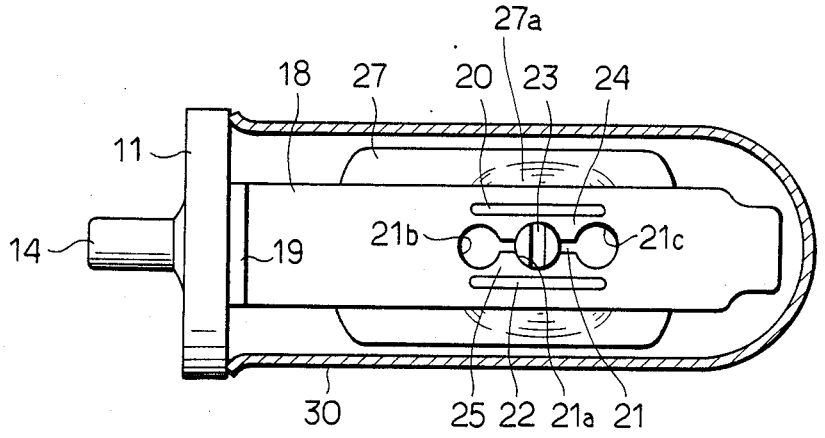
FIG. 2 is a top plan view of the snap-action type thermally responsive switch of the first embodiment in FIG. 1, in which view the switch is partly cut out.

Referring now to FIGS. 1 and 2, a header plate 11 is made of a relatively thick steel plate and has a central aperture 12. A conductive member or terminal pin 14 is secured in the aperture 12 with an electrically insulating material 13 such as glass or ceramic in insulated relation to the header plate 11. A fixed contact 15 is secured to the terminal pin 14 by way of welding or the like. Part of the fixed contact 15 engaging a movable contact 16 is clad with a contact material 17 such as silver. Provision of such a contact material 17 on the part of the fixed contact 15 is preferable in the standpoint of economy. A support 18 made of a steel plate is secured at the left end 19 to the header plate 11 by way of welding or the like, as shown in FIGS. 1 and 2. The support 18 has at the central portion three elongated slits 20 through 22 formed, for example, by way of punching with a press machine. The central slit 21 has three circular cut-out portions or openings 21*a* through 21*c* spaced from one another in the elongated direction of the slit 21. A stud bolt 23 is threaded through the central opening 21*a*. The stud bolt 23 has a larger diameter than the inner diameter of a circle defined by the opening 21*a*. The stud bolt 23 serves as a stress-applying projection to constitute an operative temperature calibrating mechanism. In this case, a threaded groove is not formed on the inside surface of the opening 21*a*, so that the stud bolt 23 advances forming the threaded groove when it is screwed into the opening 21*a* as in the case of a self-tapping screw. In the state where the stud bolt 23 is threaded through the opening 21*a*, since the diameter of the stud bolt 23 is larger than the inner diameter of the opening 21*a*, the stud bolt 23 is clamped by the inside surface of the opening 21*a* due to the stress induced across planes of band-shaped areas 24 and 25 defined by the slits 20–22. Thus, the stud bolt 23 is fastened without idle space between it and the inside surface of the opening 21*a*. A force clamping the stud bolt 23 can be adjusted at a suitable value by selecting the width of the band-shaped areas 24 and 25. Although the three slits are provided in the above-described construction, the stud bolt 23 may be prevented from loosening even where only the slit 21 is formed in the support 18.

The stud bolt 23 threaded through the aperture 21*a* of the support 18 and the band-shaped areas 24 and 25 constitute a first receiving portion, which includes an operative temperature calibrating mechanism and which acts just like a pivot in calibrating the operative temperature of the thermally responsive element.

To calibrate the operative temperature in the case of the thermally responsive switch, the bimetallic switch assembly is usually placed in a bath or chamber of a temperature-controlled oven having a narrow inside space. The atmospheric temperature is maintained at, for example, 150° C., inside the oven. The calibrating work is performed by using a suitable tool with the switch assembly placed in the bath or chamber of the oven, so that much difficulty accompanies the calibrating work in the case where a spring washer or double nut is employed for preventing the stud bolt 23 from loosening or where adhesive is applied to the stud bolt 23. However, the above-described arrangement to prevent the stud bolt 23 from loosening renders the calibrating work easy.

As shown in FIG. 1, the support 18 is bent in the vicinity of the other end into a generally U-shape. A U-shaped portion of the support 18 serves as a second receiving portion 26.

An elastic plate 28 is made of a thin metallic plate and has easier elastic deformability than a thermally responsive element 27. One end of the elastic plate 28, that is, the left end in FIG. 1, is secured to the underside of the support 18 at a portion opposite to the second receiving portion 26 by way of welding or the like. The other end thereof is connected with one end of a connecting strip 29. One end of the thermally responsive element 27 is connected with the other end of the connecting strip 29 by way of welding. The movable contact 16 made of fine silver or silver alloy is fixed on the other end of the thermally responsive element 27. The elastic plate 28 and the thermally responsive element 27 thus extend in the same elongated direction in approximately parallel relation just like pine needles. The connecting strip 29 is placed or put on the second receiving portion 26 so as to slide and be inclined thereon. Alternatively, the thermally responsive element 27 and the elastic plate 28 may be directly connected without employing the connecting strip 29 and the connection between the thermally responsive element 27 and the elastic plate 28 may be placed on the second receiving portion 26.

The thermally responsive element 27 is formed of bimetallic plates as in the prior art and includes a central shallow dish-shaped portion 27*a* formed by way of drawing so that the element 27 snaps in response to two different values of temperature. The elastic plate 28 is provided with a central aperture 28*a* through which the stud bolt 23 extends without abutting or touching the elastic plate 28. Consequently, the lower edge surface of the stud bolt 23 directly abuts and depresses the convex side of the dish-shaped portion 27*a* of the thermally responsive element 27 when it is in the contacts-closed position.

The above-described thermally responsive switch assembly is enclosed in a switch housing 30 formed of a steel plate by way of drawing. A left open end of the housing is secured to the header plate 11 by way of welding or the like as shown in FIGS. 1 and 2.

In the snap-action type thermally responsive switch described above, the convex side of the dish-shaped portion 27*a* of the thermally responsive element 27 is depressed by the stud bolt 23 when the element 27 is in the contacts-closed position, which position is shown by solid line in FIG. 1. In this position, when the pressure induced by the stud bolt 23 is transmitted to the thermally responsive element 27, a force is exerted on both ends thereof. The force is transmitted to the second receiving portion 26 and the fixed contact 15 through the connecting strip 29 and the movable contact 16 respectively. Consequently, a stress is applied to the thermally responsive element 27 so that the dish-shaped portion 27*a* is expanded. The stress intensity determines the temperature at which the thermally responsive element 27 snaps from the solid-line contacts-closed position to the dotted-line contacts-open position as shown in FIG. 1. The stress intensity determining the operative temperature of the element 27 is precisely adjusted by the stud bolt 23. As described above, since the stud bolt 23 is effectively prevented from loosening after the calibration of the temperature, deviation of the calibrated temperature with lapse of time does not occur to the switch in accordance with this invention.

The elastic plate 28 serves to electrically connect the thermally responsive element 27 with the header plate 11. In addition, it has an important operation for the snap-acting movement of the element 27. That is, since the elastic plate 28 is elastically deformable as compared with the thermally responsive element 27, the connecting strip 29 is allowed to slide and be inclined on the second receiving portion 26 in accordance with the intensity of stress applied by the stud bolt 23 when the operative temperature of the thermally responsive element 27 is calibrated. The pressure exerted on the element 27 by the stud bolt 23 is dispersed over the element 27, so that the portion thereof connected with the strip 29 is prevented from suffering plastic deformation because the pressure is not concentrated on the portion. Furthermore, when the thermally responsive element 27 snaps to the contacts-open position at a predetermined operative temperature, for example, 150° C., with the dish-shaped portion 27*a* inverted, as shown by dotted line in FIG. 1, the elastic plate 28 acts to push the supported end of the thermally responsive element 27, that is, the right end thereof shown in FIG. 1, against the receiving portion 26. Consequently, a biasing force is exerted on the thermally responsive element 27 by the elastic plate 28 so that the element 27 is moved in the clockwise direction about a first receiving portion, that is, the distal end of the stud bolt 23 to thereby maintain the contacts 15 and 16 at the contacts-open position. Furthermore, when the thermally responsive element 27 snaps to the dotted-line contacts-open position, the elastic plate 28 acts to prevent over-travel of the free end of the element 27 and absorb the impact induced at the snap action of the element 27. Consequently, fatigue of the element 27 due to the impact is decreased when the element 27 reiterates its snap action, thereby lengthening the life of the element 27.

As described above, the snap-action type thermally responsive switch of the first embodiment operates to open the contacts 15 and 16 when the atmospheric temperature increases to the operative temperature, for example, 150° C., as shown by the dotted line in FIG. 1 and close the contacts 15 and 16 when the atmospheric temperature decreases due to natural cooling, for example, to 100° C. Accordingly, when the switch is provided in the vicinity of the winding of an electric motor and connected so that current flowing into the winding further flows to the switch through the contacts 15 and 16 and the thermally responsive element 27, it senses excessive heat or current to thereby break the motor circuit, so that it preferably serves as a motor-protecting device.

Figure 3:
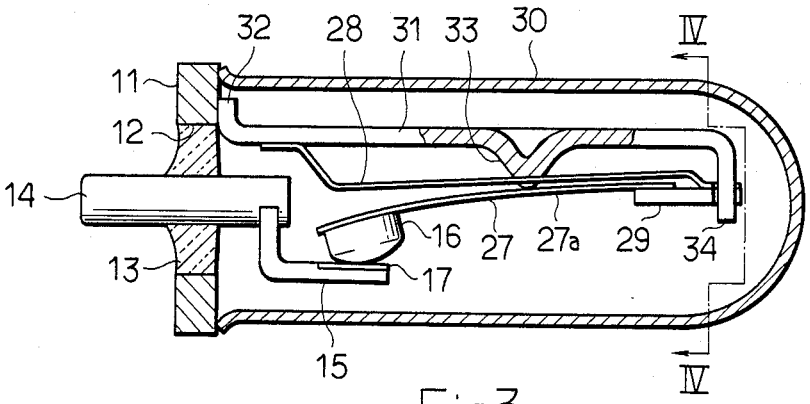
FIG. 3 is a view similar to FIG. 1 illustrating a snap-action type thermally responsive switch of a second embodiment.
Figure 4:
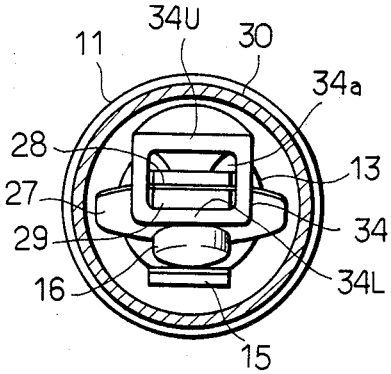
FIG. 4 is a longitudinal cross sectional view taken along line IV—IV in FIG. 3.
Figure 5:
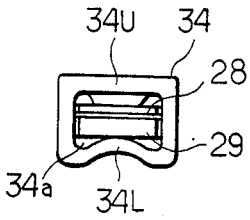
FIG. 5 is an elevational view illustrating a frame of a support after suffering the plastic deformation and part of a member received by the support shown in FIG. 4.

A second embodiment will now be described with reference to FIGS. 3 through 5, wherein same parts are labelled by the same numerals as those in the first embodiment. In the snap-action type thermally responsive switch of the second embodiment, the operative temperature calibrating mechanism is provided at a second receiving portion 34 of a support 31 while it is provided at the first receiving portion in the first embodiment. The left end 32 of the support 31 is fixed to the header plate 11 formed of a steel or the like by way of welding, as shown in FIG. 3. The support 31 is provided, at approximately central portion, with a dimple formed by way of drawing with a press machine, which dimple serves as a first receiving portion 33, that is, a stress-exerting projection. The free end of the support 31 is bent downwardly as shown in FIG. 3 so as to have a generally L-shape. A downwardly bent portion 34 has a central rectangular aperture 34*a* defined by a closed loop wall or frame as shown in FIG. 4.

When the thermally responsive element 27 is in the contacts-closed position, the convex side of the dish-shaped portion of 27*a* abuts against the first receiving portion 33 and the movable contact 16 is engaging the fixed contact 15. The right ends of the thermally responsive element 27 and the elastic plate 28 are connected with the connecting strip 29 in the same manner as in the first embodiment. The connecting strip 29 is placed or put on the lower side 34L of the frame 34 of the support 31 for slidable and inclinable movement. Contact pressure between the contacts 15 and 16 is adjusted by exerting a force between the upper side 34U and the lower side 34L by way of clamping with a suitable tool (not shown) to thereby deform the frame 34 so that the lower side 34L is inwardly bent as shown in FIG. 5. The deformation of the frame 34 causes the connecting strip 29 to change a position of the received portion thereof in relation to the first receiving portion 33. As the result of the deformation of the frame 34, the same stress is applied to the thermally responsive element 27 as applied by the stud bolt 23 in the first embodiment, thereby calibrating a predetermined operative temperature, for example, at 150° C. The frame 34 corresponds to the second receiving portion including the operative temperature calibrating mechanism. As described above in connection with the operative temperature calibrating mechanism, the stress exerted on the thermally responsive element 27 needs unchanging its intensity after calibrating the operative temperature of the switch, that is, the connecting strip 29 connecting the thermally responsive element 27 and the elastic plate 28 needs unchanging its position after calibration of the operative temperature. In this regard, the frame 34 has a closed-loop configuration, which minimizes the occurrence of spring-back after plastic deformation thereof and which satisfies the above-mentioned requirement. Suppose now that the support 31 in the second embodiment has a generally U-shaped second receiving portion such as shown in FIG. 1 with the dimple as the first receiving portion formed and that the U-shaped portion is bent to thereby determine the position of the connecting strip 29 in calibrating the operative temperature. In this case, the occurrence of spring back is increased at the U-shaped portion, whereby increase of deviation of the operative temperature renders the second receiving portion unpreferable as an operative temperature calibrating mechanism.

The snap-action type thermally responsive switch of the second embodiment provides the same effect as that in the first embodiment.

Figure 6:
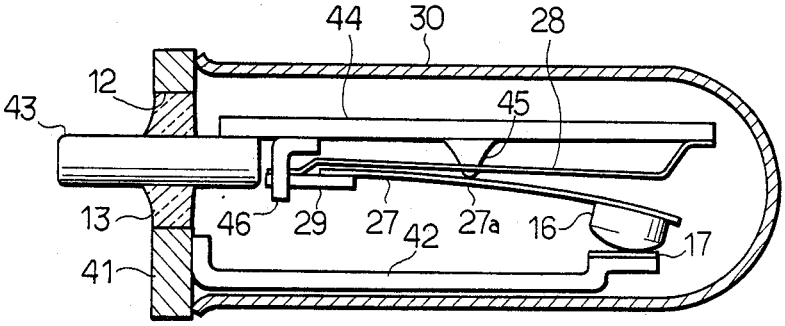
FIG. 6 is a view similar to FIG. 1 illustrating a snap-action type thermally responsive switch of a third embodiment.

FIG. 6 shows a third embodiment of the invention. A fixed contact arm 42 is secured to a header plate 41. A support 44 is secured at one end thereof to a terminal pin or conductive member 43 fixed in electrically insulated relation to the header plate 41. The support 44 is provided with a first receiving portion 45 formed into the configuration of a dimple. A second receiving member 46 is secured on the left side of the support 44 as shown in FIG. 6. The receiving member 46 has the same configuration as denoted at 34 in FIG. 4. The connecting strip 29 is received by the member 46 in the same manner as described with reference to FIG. 4. The thermally responsive element 27 and the elastic plate 28 are connected with the connecting strip 29 in the same manner as described with reference to and shown in FIGS. 1 or 3. Since other arrangements shown in FIG. 6 are the same as those illustrated in FIG. 1, same parts are labelled by the same numerals as those in FIG. 1. The operation of the switch of the third embodiment can easily understood from description of the former embodiments, so that detailed description of the operation will be eliminated.

The advantages of the third embodiment consist in that not only the heating due to resistivity of the thermally responsive element 27 but also the heating of other electrical path forming members are effectively employed for the snap action of the element 27 because the switch is provided with a relatively long electric path and further that the insulating member 13 is prevented from damage due to arc induced in opening the contacts 15 and 16 because they are away from the insulating member 13.

The foregoing disclosure and drawings are merely illustrative of the principles of this invention and are not to be interpreted in a limiting sense. The only limitation is to be determined from the scope of the appended claims.

What is claimed is:

1. A snap-action type thermally responsive switch comprising:

(a) a switch housing;

(b) a fixed contact provided in said switch housing;

(c) an elongated support secured in said switch housing and having an elongated slit formed at a suitable portion thereof away from one end thereof and a circular cut-out opening formed in said slit, said support including a receiving portion formed away from said slit;

(d) a thermally responsive element having a movable contact fixed at one end thereof in engaging and disengaging relation to said fixed contact and a shallow dish-shaped portion formed at a suitable portion thereof for inducing snap action thereof;

(e) an elastic plate cantilever mounted in said switch housing at one end and having easier elastic deformability than said thermally responsive element, said elastic plate being connected at the other end with the other end of said thermally responsive element so that said elastic plate and said thermally responsive element extend in the same elongated direction in an opposed relation and further that a connection between said elastic plate and said thermally responsive element is placed on said receiving portion of said support for inclinable movement; and (f) a stud bolt for calibrating the operative temperature of said thermally responsive element, said stud bolt having a larger diameter than that of said circular cutout opening and being threaded through said opening, said stud bolt having its distal end engage a convex side of said dish-shaped portion of said thermally responsive element when said element is in a contacts-closed position, whereby a force is exerted by said stud bolt so that said connection and said movable contact are depressed against said receiving portion of said support and said fixed contact respectively.

2. A snap-action type thermally responsive switch as set forth in claim 1, wherein said elongated slit is formed in said support so that band-shaped areas are respectively formed at both sides of said elongated slit in which said circular cut-out opening is provided.

3. A snap-action type thermally responsive switch as set forth in claim 1, wherein said elastic plate and said thermally responsive element are connected with an electrically conductive connecting strip which serves as said connection placed on said receiving portion of said support.

4. A snap-action type thermally responsive switch as set forth in claim 1, wherein said support is bent and wherein said receiving portion is part of the bent portion of said support.

5. A snap-action type thermally responsive switch comprising:

(a) a switch housing;

(b) a fixed contact provided in said switch housing;

(c) a support secured in said switch housing and having a dimple and a frame portion substantially formed integrally therewith respectively, said frame portion having a closed loop wall which defines an opening and which is plastically deformable to thereby change the configuration of said opening;

(d) a thermally responsive element provided in said switch housing and having a movable contact fixed at one end thereof in engaging and disengaging relation to said fixed contact and a shallow dish-shaped portion formed at a suitable portion for inducing snap action; and (e) an elastic plate cantilever mounted in said switch housing at one end and having easier elastic deformability than said thermally responsive element, said elastic plate being connected at the other end with the other end of said thermally responsive element so that said elastic plate and said thermally responsive element extend in the same elongated direction in an opposed relation and further that a connection between said elastic plate and said thermally responsive element is placed on an inner edge of said opening of said support for inclinable movement, said support having said dimple engage a convex side of said dish-shaped portion of said thermally responsive element when said element is in a contacts-closed position, whereby a force is exerted by said dimple so that said connection and said movable contact are depressed against the inner edge of said opening and said fixed contact respectively.

6. A snap-action type thermally responsive switch as set forth in claim 5, wherein said elastic plate and said thermally responsive element are connected with a connecting strip which is placed on the inner edge said opening of said frame.

* * * * *